US006537029B1

(12) United States Patent
Chen-Lung et al.

(10) Patent No.: US 6,537,029 B1
(45) Date of Patent: Mar. 25, 2003

(54) ELECTRIC FAN CAPABLE TO ROTATE FOR 360 DEGREES

(76) Inventors: Huang Chen-Lung, P.O. Box 2-10, Tainan City (TW); Huang Chuang-Pan, P.O. Box 2-10, Tainan City (TW)

( * ) Notice: Subject to any disclaimer, the term of this patent is extended or adjusted under 35 U.S.C. 154(b) by 9 days.

(21) Appl. No.: 09/976,755

(22) Filed: Oct. 8, 2001

(51) Int. Cl.[7] ..... B63H 1/06

(52) U.S. Cl. ..... 416/169 R; 416/170 R; 416/247 R

(58) Field of Search ..... 416/110, 100, 416/247 R, 170 R, 169 R

(56) References Cited

U.S. PATENT DOCUMENTS 4,472,110 A * 9/1984 Sun Keu ..... 416/110
5,013,224 A * 5/1991 Liao ..... 417/423.5
5,266,004 A * 11/1993 Tsumurai et al. ..... 416/100

* cited by examiner

*Primary Examiner*—Edward K. Look
*Assistant Examiner*—Dwayne J. White

(57) ABSTRACT

An electric fan capable to rotate for 360 degrees includes a control device consisting of a left and a right shell combined together. The shells have a L-shaped steel plate inside to fix a motor and a speed-reducing device. The speed-reducing device has its spindle fitted with the fixed shaft of a clutch having bead hole for receiving two steel beads and a spring. A shaft sleeve has bead grooves for receiving two aforesaid steel beads and firmly fitted in a copper sleeve by a bolt screwing through a bolthole and resting against a concave groove of the stand post. The shells further have a shaft groove for receiving the upper half portion of the stand post, thus, the upper half portion is actuated by the control device to rotate with an angle from 0 degree to 360 degrees.

2 Claims, 7 Drawing Sheets

ELECTRIC FAN CAPABLE TO ROTATE FOR 360 DEGREES

BACKGROUND OF THE INVENTION

This invention relates to an electric fan, particularly to one capable to rotate for 360 degrees, elevating effect of cooling and achieving good effect of air convection in a room.

A conventional desk electric fan or stand electric fan is provided with a speed-reducing device C fixed on the rear end of the spindle B1 of a motor B, the speed-reducing device having its spindle C1 fixed with a connect rod C2 fixedly connected to a stand base D. Thus, when the motor B activates the fan blade to rotate, an eccentric rod C3 of the speed-reducing device C will control the spindle C1 to rotate or stop rotating so as to adjust the angles of wind blowing of the electric fan.

However, the angles of wind blowing of the conventional electric fan are generally restricted to between 90 degrees and 100 degrees so that it cannot produce good effect of air convection in a room, thus resulting in a dead-locked condition in the circulation of air in a room.

SUMMARY OF THE INVENTION

The objective of the invention is to offer an electric fan capable to rotate for 360 degrees, possible to enhance effect of cooling and air convection and elevate its practical value.

One feature of the invention is a control device provided on the stand post of an electric fan to control the angles of wind blowing from 0 degree to 360 degrees, and another feature of the invention is to have the control device provided between the upper half portion and the lower portion of the stand post or between the top side of the stand post and the fixed base of the fan blade motor to display a function of controlling the angles of wind blowing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
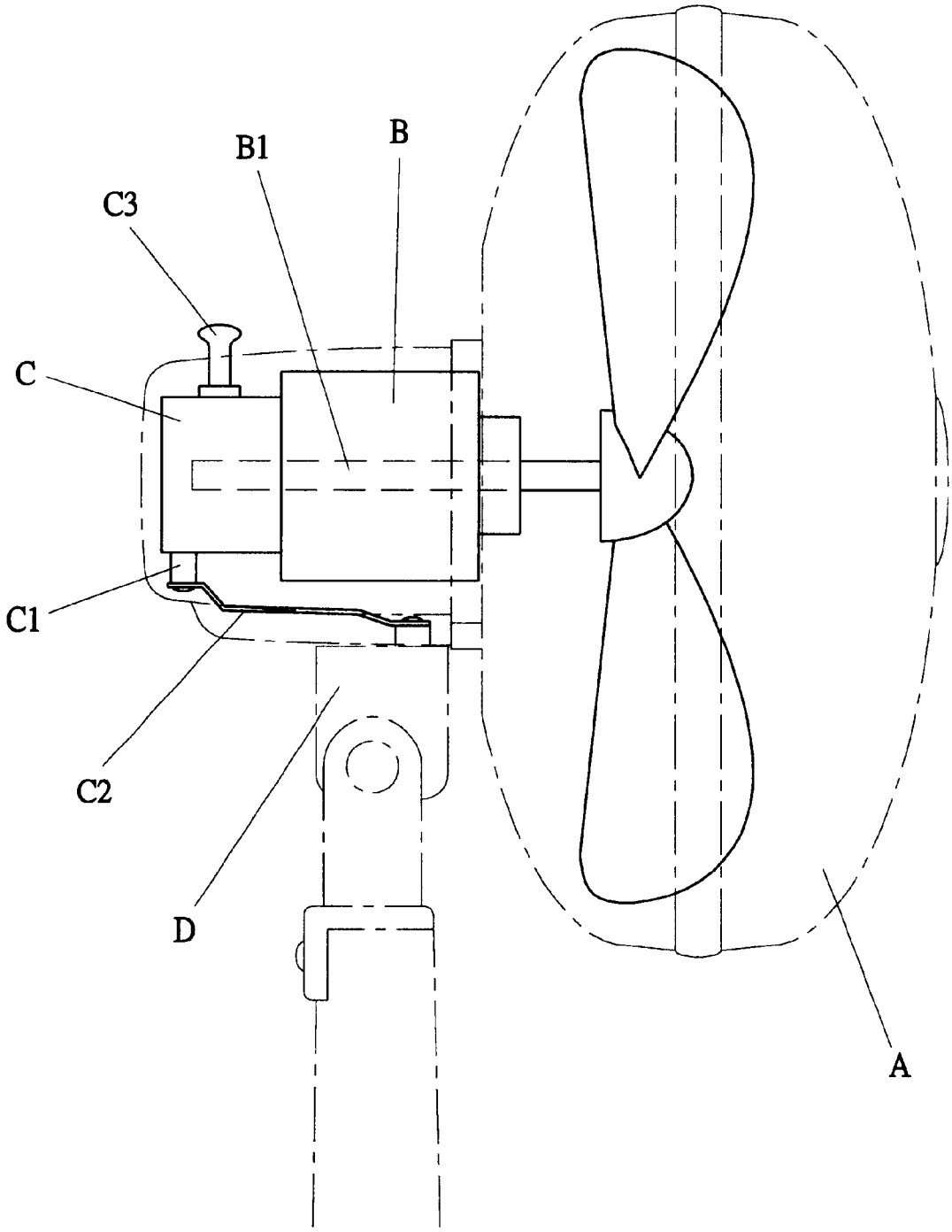
FIG 1 (PRIOR ART)
FIG. 1 is a partial perspective view of a conventional electric fan.
Figure 2:
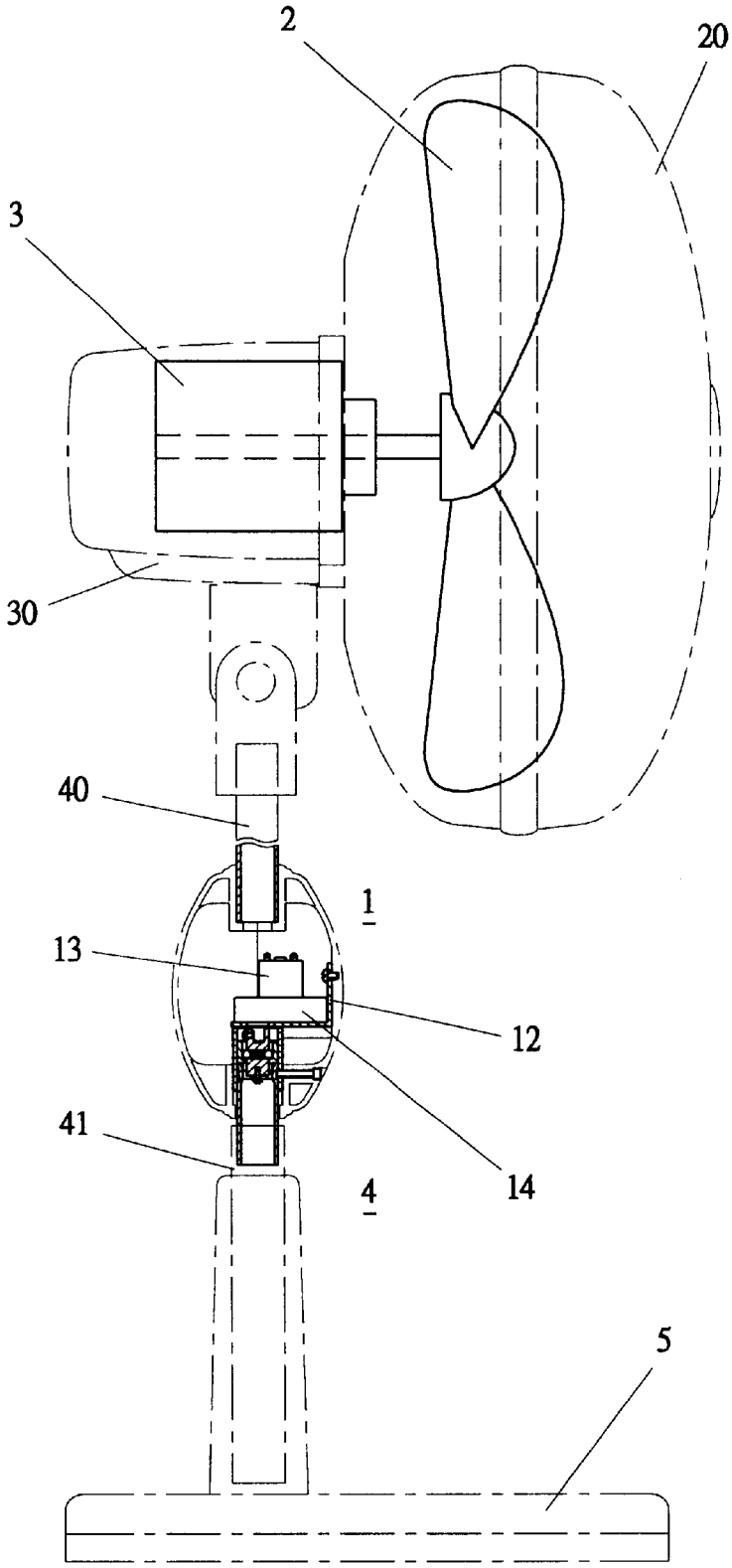
FIG. 2 is a perspective view of a first embodiment of an electric fan in the present invention.

A first preferred embodiment of an electric fan capable to rotate for 360 degrees in the present invention, as shown in FIG. 2, includes a control device 1, a fan blade 2, a fan-blade motor 3, a stand post 4 and a base 5 as main components combined together.

Figure 5:
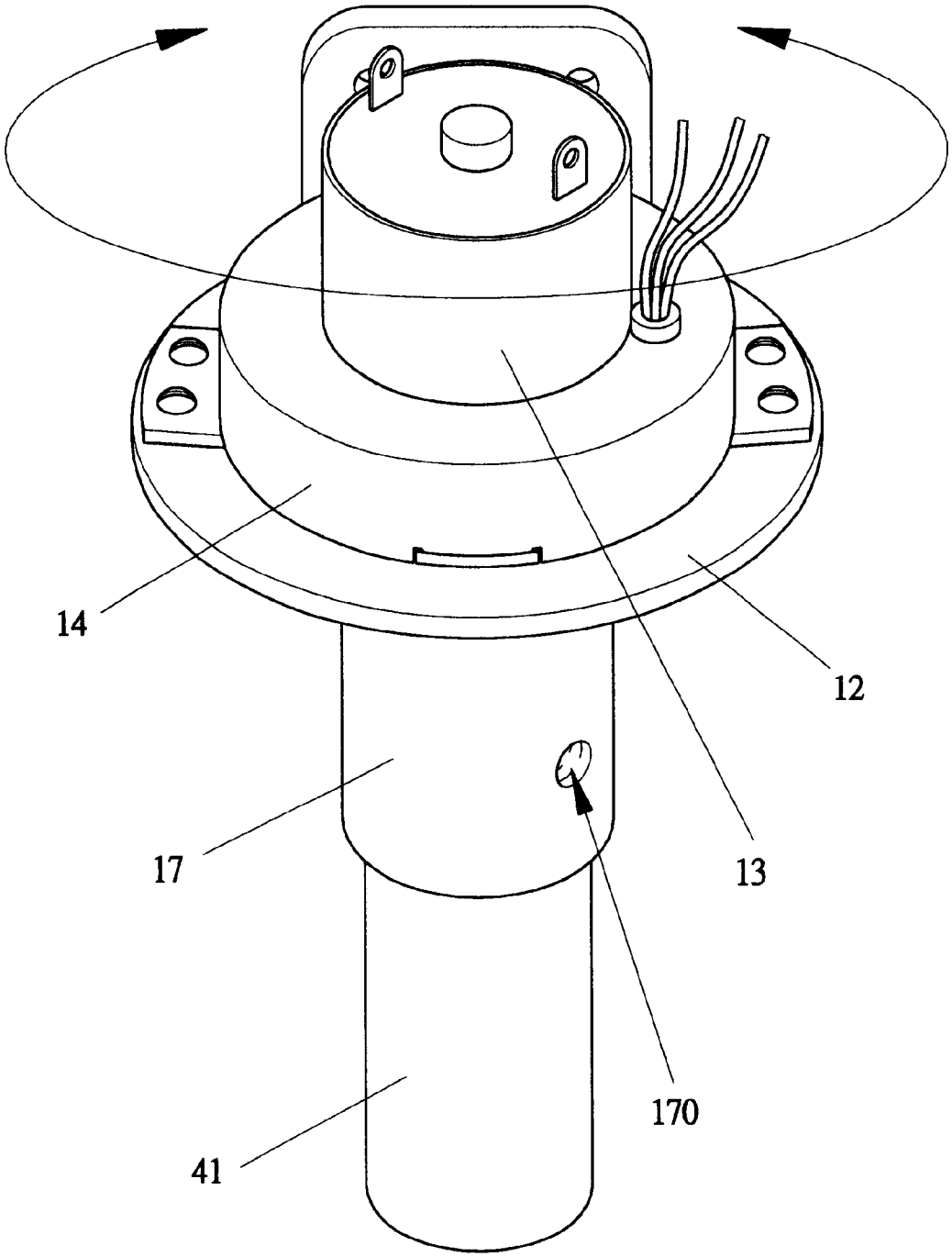
FIG. 5 is a perspective view of the control device of the electric fan in the present invention.
Figure 6:
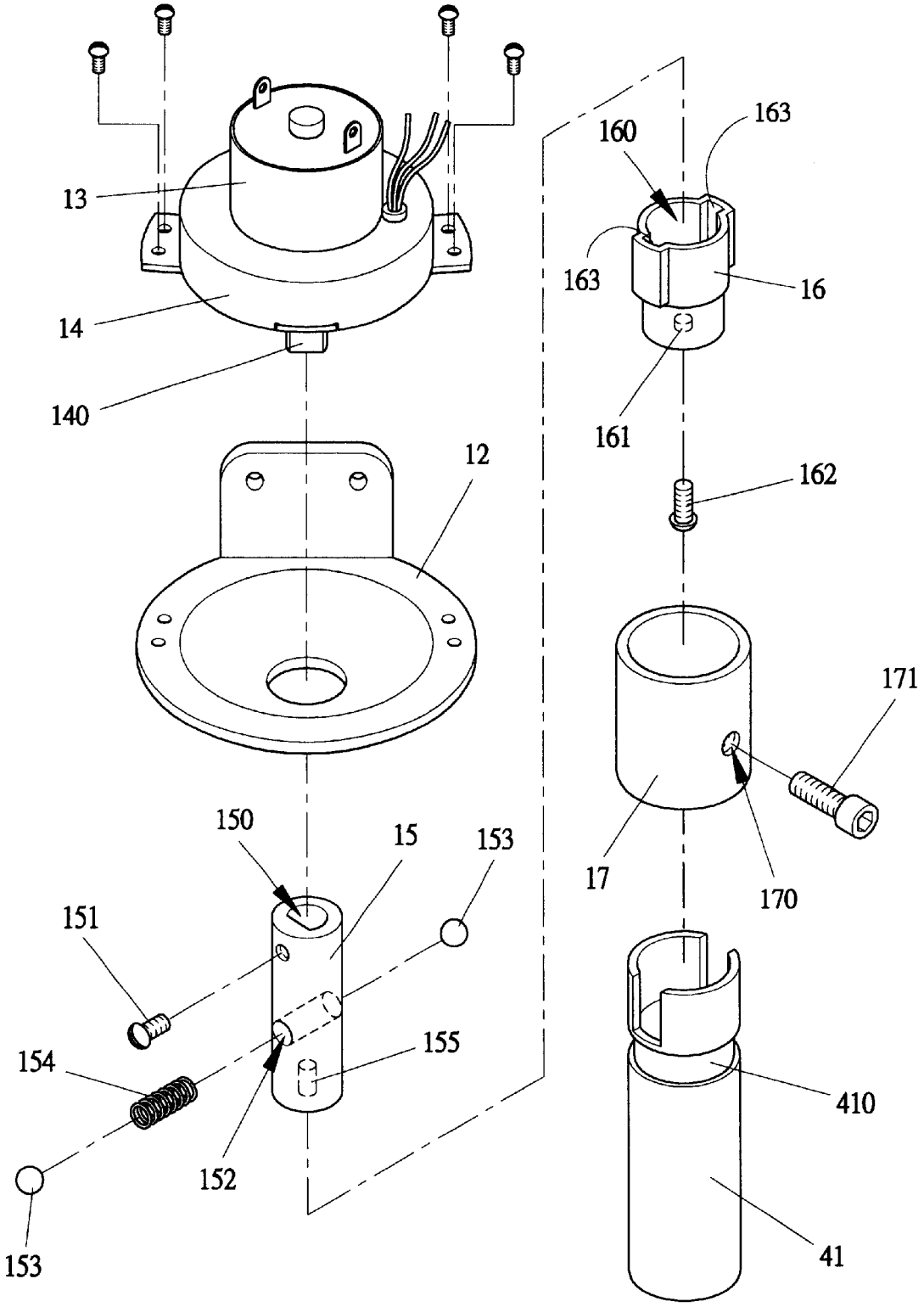
FIG. 6 is an exploded perspective view of the control device of the electric fan in the present invention.

The control device 1 consists of a left and a right shell 10, 11 combined into a shell body for receiving other components. A shaft groove 100 is provided on a rear upper portion of the shell body for the upper half portion 40 of the stand post 4 to insert therein so as to fix the fan blade 2 and other components in place. Then, a L-shaped steel plate 12 is combined with the left shell 10 by means of a bolt 120 and also fixed with the casing of a speed-reducing device 14, as shown in FIGS. 4, 5 and 6 to permit the motor 13 and the speed-reducing device 14 secured firmly within the shells 10 and 11.

The speed-reducing device 14 is positioned under a motor 13 and rotated by the motor 13, with its spindle 140 inserted and fixed stably in the groove 150 of the fixed shaft 15 of a clutch by means of a bolt 151. Besides, the fixed shaft 15 of the clutch has a through bead hole 152 bored horizontally for two steel beads 153 and a spring 154 to fit therein and a vertical female threaded hole 155 formed in a lower end. Then, a shaft sleeve 16 has a groove 160 on a top side for receiving the fixed shaft 15 of the clutch and a vertical through hole 161 in a lower side, with a bolt 162 screwing through the through hole 161 and in the female threaded hole 155 and combining them firmly in place.

Figure 4:
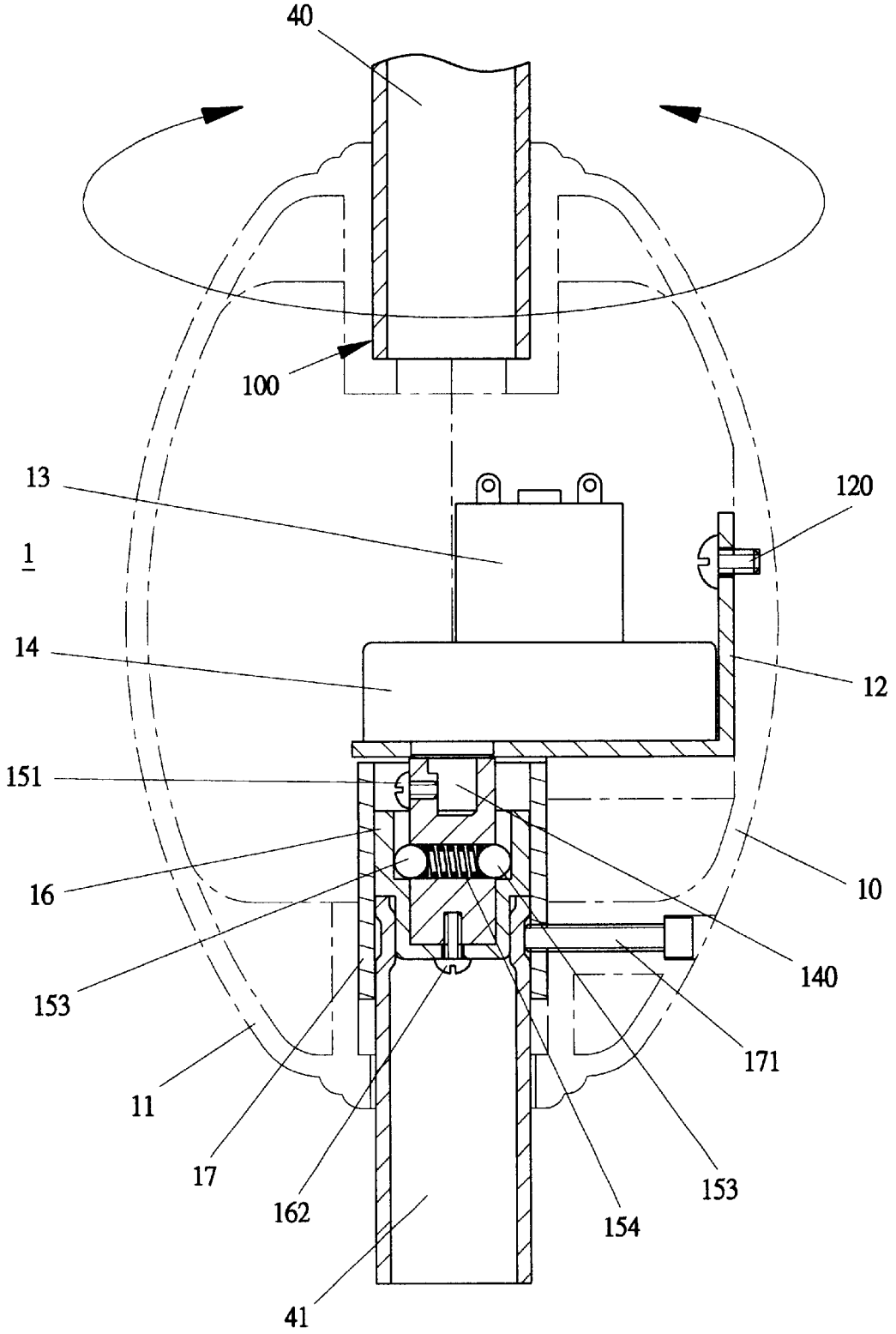
FIG. 4 is a magnified cross-sectional view of a control device of the electric fan in the present invention.
Figure 7:
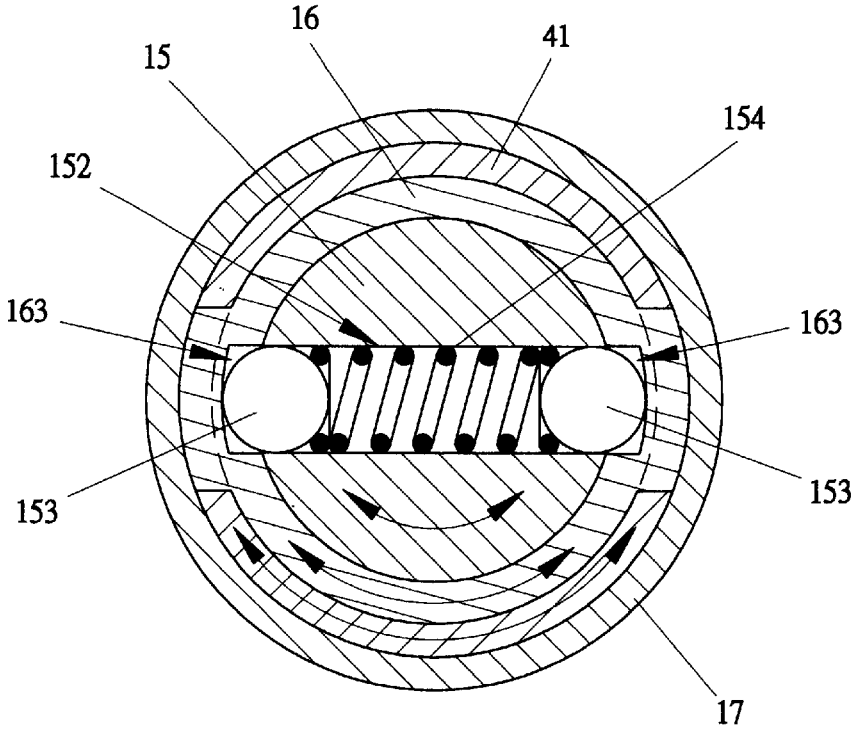
FIG. 7 is a first top view of a clutch device of the electric fan in the present invention.
Figure 8:
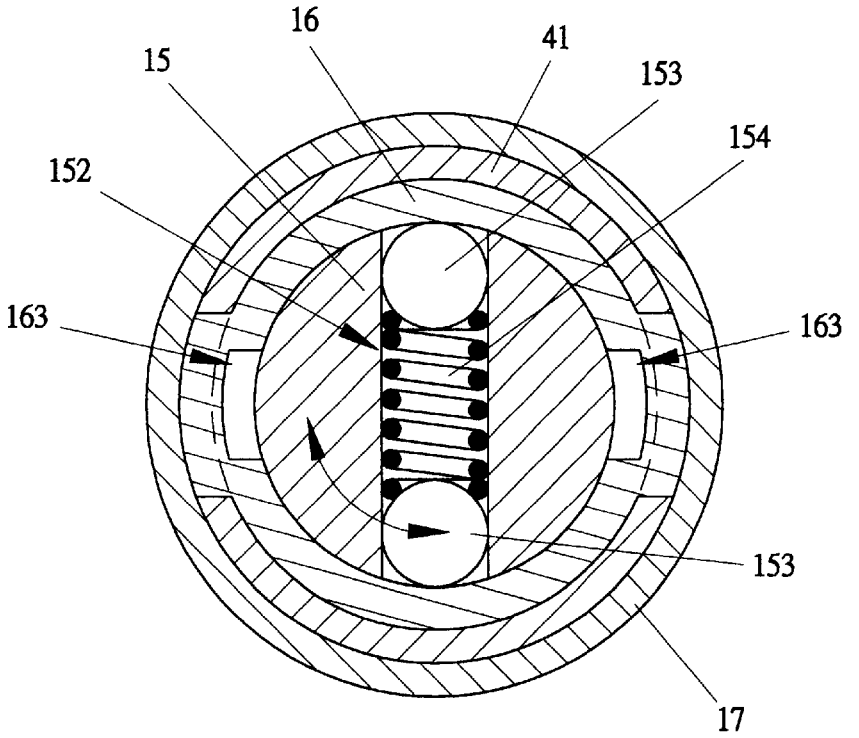
FIG. 8 is a second top view of the clutch device of the electric fan in the present invention.

In addition, the shaft sleeve 16 is provided with two steel bead grooves 163 protruding outward oppositely for receiving two steel beads 153, as shown in FIGS. 4, 7 and 8, so that, once the fan blade 2 and other components of the control device 1 are blocked by exterior force and stop rotating, the steel beads 153 of the clutch will eccentrically move away from the bead grooves 163 to let the motor 13 cut off electricity, as shown in FIG. 8. Further, a copper sleeve 17 having a threaded hole 170 on one side is fitted around the shaft sleeve 16 and firmly fixed together by a bolt 171 screwing through the threaded hole 170 and then resisting against a concave groove 410 formed around the lower half portion 41 of the stand post 4, as shown in FIG. 4.

Thus, when the motor 13 starts rotating together with the whole control device 1, the upper half portion 40 of the stand 4 together with the fan blade 2 and other components positioned on its top side are activated to rotate synchronously, with an angle of wind blowing from 0 degree to 360 degrees, no matter rotating leftwards or rightwards, accordingly enhancing effect of air circulation in a room.

Figure 3:
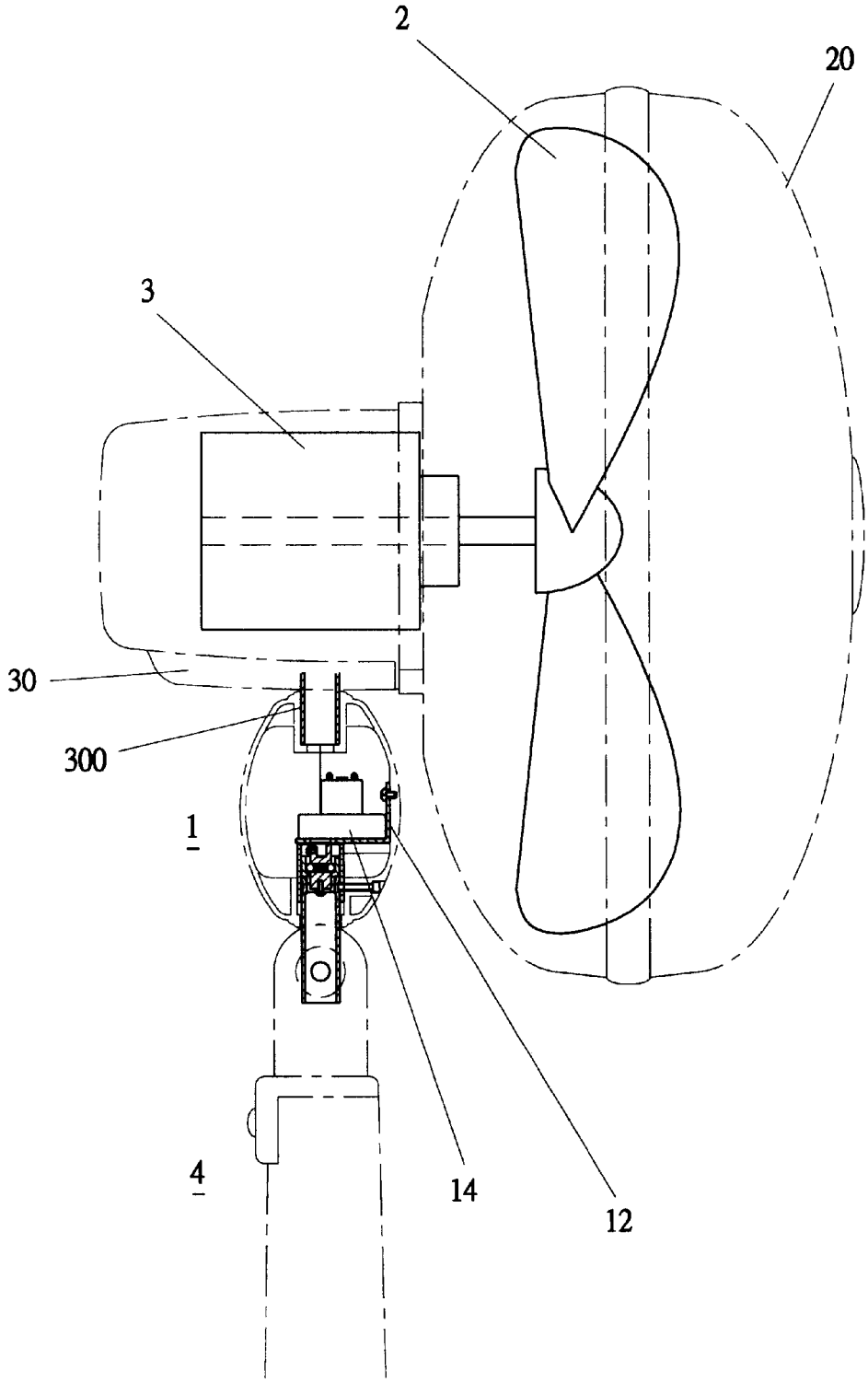
FIG. 3 is a perspective view of a second embodiment of the electric fan in the present invention.

A second preferred embodiment of an electric fan capable to rotate for 360 degrees in the present invention, as shown in FIG. 3, has the same components and structure as those of the first preferred embodiment described above, only the control device 1 is provided on the top side of the stand post 4 and connected with the fixed base 30 under the fan blade motor 3 by means of a shaft 300, letting the control device 1 positioned between the stand post 4 and the shaft 300.

While the preferred embodiments of the present invention have been described above, it will be recognized and understood that various modifications may be made therein and the appended claims are intended to cover all such modifications that may fall within the spirit and scope of the invention.

What is claimed is:

1. An electric fan capable to rotate for 360 degrees comprising a fan blade, a safety net, and a fan blade motor for controlling said fan blade to rotate, said fan blade motor provided with a fixed base connected with a stand post, and a base resting on the ground and connected to a lower end of said stand post; and, characterized by said stand post divided into an upper half portion and a lower half portion, having a control device provided between said two half portions, said control device consisting of a left and a right shells combined together, a shaft groove provided on a rear upper portion of said two shells for receiving said upper half portion of said stand post, an L-shaped steel plate provided for fixing said left shell by means of a bolt and also fixed stably with the casing of a speed-reducing device, said speed-reducing device having its spindle inserted in a groove of a fixed shaft of a clutch and firmly secured therein by means of a bolt, said fixed shaft of said clutch having a horizontal bead hole for receiving two steel beads and a spring, said fixed shaft of said clutch further having a vertical female threaded hole at a lower side, a shaft sleeve having a groove on top side for receiving said fixed shaft of said clutch and a through hole at a lower side aligned with said female threaded hole of said fixed shaft and screwed by a bolt to firmly combine together said shaft sleeve and said fixed shaft of said clutch, said shaft sleeve provided with steel bead grooves protruding outward for receiving two said steel beads, further a copper sleeve provided to fit around an outer circumference of said shaft sleeve and having a threaded hole on one side, said copper sleeve combined with said lower half portion of said stand post by means of a bolt screwing through said threaded hole of said copper sleeve and then firmly resting against an annular concave groove of said lower half portion of said stand post, thus said motor starting to rotate together with said control device, said upper half portion of said stand post and said fan blade activated to rotate at the same time with an angle of wind blowing from 0 degree to 360 degrees.

2. The electric fan capable to rotate for 360 degrees comprising a fan blade, a safety net and a fan blade motor for controlling said fan blade to rotate, said fan blade motor provided with a fixed base connected with an upper end of a stand post having a lower end combined with a base: and, characterized by said control device provided on a top end of said stand post and connected with a shaft of said fixed base of said fan blade motor, said control device positioned between said stand post and said shaft of said fixed base, said control device consisting of a left and a right shells combined together, said two shells having a groove on a rear upper portion for said shaft of said fixed base to insert therein, an L-shaped steel plate provided to combine with said left shell by a bolt and also fixed with the casing of said speed-reducing device, said L-shaped steel plate securing said motor and said speed-reducing device in place, said speed-reducing device positioned under said motor and having its spindle inserted in a groove of a fixed shaft of a clutch and fixed together by a bolt, said fixed shaft of said clutch having a horizontal bead hole for two steel beads and a spring to fit therein, said fixed shaft of said clutch further having a vertical female threaded hole at a lower side, said shaft sleeve having a groove on top for receiving said fixed shaft of said clutch and a through hole at a lower side corresponding to said female threaded hole of said fixed shaft, a bolt screwing through these two said holes to firmly combine together said shaft sleeve and said fixed shaft of said clutch, said shaft sleeve provided with steel bead grooves protruding outward for receiving two said steel beads, further a copper sleeve fitted around an outer circumference of said shaft sleeve and having a threaded hole bored on one side, said copper sleeve combined with said lower half portion of said stand post and having an annular concave groove for a bolt screwing through said threaded hole of said copper sleeve and then resting stably against said concave groove of said lower half portion of said stand post, thus said motor starting to rotate together with said control device, said upper half portion of said stand post and said fan blade activated to rotate synchronously with an angle of wind blowing from 0 degree to 360 degrees.

* * * * *